US005722198A

United States Patent [19]

Bader

[11] Patent Number: 5,722,198

[45] Date of Patent: Mar. 3, 1998

[54] BUILDING WALL ASSEMBLY METHOD

[76] Inventor: Harold Bader, 11111 Biscayne Blvd., #753, N. Miami, Fla. 33181-3404

[21] Appl. No.: 319,627

[22] Filed: Oct. 7, 1994

Related U.S. Application Data

[63] Continuation-in-part of Ser. No. 983,547, Feb. 3, 1993, abandoned.

[51] Int. Cl.[6] ..... T04C 2/34

[52] U.S. Cl. ..... 52/745.09; 52/800.12; 52/745.2; 52/309.4; 52/309.7

[58] Field of Search ..... 52/309.4, 309.12, 52/657, 264, 800.12, 246.1, 793.1, 794.1, 745.09, 745.19, 745.2, 745.1, 309.9, 309.7; 264/138, 154, 164, 62, 45.2, 50

[56] References Cited

U.S. PATENT DOCUMENTS

| | | | |
|---|---|---|---|
| 2,682,235 | 6/1954 | Fuller . | |
| 2,881,717 | 4/1959 | Fuller . | |
| 2,905,113 | 9/1959 | Fuller . | |
| 2,908,048 | 10/1959 | Johnson | 52/293.1 X |
| 2,914,074 | 11/1959 | Fuller . | |
| 3,139,957 | 7/1964 | Fuller . | |
| 3,197,927 | 8/1965 | Fuller . | |
| 3,203,144 | 8/1965 | Fuller . | |
| 3,271,919 | 9/1966 | Olton | 52/823 |
| 3,445,974 | 5/1969 | Bragman | 52/309.2 X |
| 3,775,920 | 12/1973 | Schneller | 52/823 |
| 3,810,336 | 5/1974 | Sadao | 52/81 |
| 4,242,848 | 1/1981 | Schoultz | 52/823 |
| 4,603,531 | 8/1986 | Nash | 52/806 |
| 4,633,634 | 1/1987 | Nemmer et al. | 52/282.1 X |
| 4,637,195 | 1/1987 | Davis | 52/657 X |
| 4,646,502 | 3/1987 | Ziehbrunner | 52/580 X |
| 4,769,963 | 9/1988 | Meyerson | 52/309.9 |
| 4,774,119 | 9/1988 | Imhoff | 52/309.2 X |
| 4,779,707 | 10/1988 | Smith et al. | 52/264 X |
| 4,813,193 | 3/1989 | Altizer | 52/309.4 X |
| 5,033,248 | 7/1991 | Phillips | 52/745.1 X |
| 5,086,599 | 2/1992 | Meyerson | 52/309.9 X |
| 5,335,472 | 8/1994 | Phillips | 52/745.1 X |
| 5,398,472 | 3/1995 | Eichelkraut | 52/745.09 X |

FOREIGN PATENT DOCUMENTS

| | | | |
|---|---|---|---|
| 0396368 | 1/1966 | Switzerland | 52/282.2 |

*Primary Examiner*—Carl D. Friedman
*Assistant Examiner*—Winnie Yip
*Attorney, Agent, or Firm*—Robert J. Van Der Wall

[57] ABSTRACT

A method of fabricating a load-bearing, insulating building wall on a building foundation includes the steps of forming a foam core having an interior face and an exterior face and opposing side edges each having a length, a top edge and a bottom edge; forming a groove in the interior face and a groove in the exterior face; forming a vertical member having a web portion with web portion longitudinal edges, a flange portion at each the web portion longitudinal edge, the flange portions each having a flange portion longitudinal edge, and a ledges at each the flange portion longitudinal edge; positioning the vertical member such that the ledges are aligned with one end of the grooves; sliding the vertical member into and along the grooves to substantially cover the first side edge; forming a foot member having a web portion with two longitudinal edges and a flange portion at each the web portion longitudinal edge; forming a cap member having a web portion with two longitudinal edges and a flange portion at each the web portion longitudinal edge, fitting the cap and foot members over the top and bottom edges of the core; joining the vertical, cap and foot members together with fasteners, lifting the panel and placing the foot member into a foundation perimeter recess, such that the foot member opening fits around a concrete fastener element; orienting the panel in an upright position; securing the panel into the recess with fastening elements.

5 Claims, 6 Drawing Sheets

BUILDING WALL ASSEMBLY METHOD

FILING HISTORY

This application is a continuation-in-part of application Ser. No. 07/983,547, filed on Feb. 3, 1993 now abandoned.

FIELD OF THE INVENTION

The present invention relates to the field of construction methods using modular building components and, more particularly, to a method of building a load-bearing, insulating wall which can be safely executed by a single workman without lifting equipment and which achieves great insulation and strength with light weight by using a composite of materials that produce a synergistic effect as a consequence of an interlocking relationship and makes use of the highly specific qualities of each material.

BACKGROUND OF THE INVENTION

Much of the construction of buildings in the industrialized world, particularly in the United States, is of two types, wood frame and various kinds of material, including wood to cover the framework, or steel, usually taken in combination with concrete in the form of prestressed concrete for framing and a variety of other materials to cover the same, frequently concrete block. On larger buildings, a prestressed concrete frame may be covered by glass, marble, stone, or the like. In all of the above cases, insulation, which has become ever more important in an increasingly energy conscience world, is frequently supplied as a separate layer interiorly of the outside structure above-described. When the covering material is concrete block, insulation in at least the exterior walls is frequently omitted.

In order to achieve economies in the cost of construction, various efforts have been made to utilize pre-fabricated materials. Of course, the ultimate in pre-fabrication is with mobile homes which are simply transported to the residence site, and usually then permanently fixed to a foundation. Other types of pre-fabricated or partially pre-fabricated construction methods are also well known such as A frame homes that are frequently used in rural areas as vacation retreats. There have also been very sophisticated structures such as geodesic dome type structures of a type advocated by the well known American inventor Richard Buckminster Fuller. Examples of United States patents of this species either by Fuller or his associates are U.S. Pat. No. 2,682,235 for a geodesic dome, U.S. Pat. No. 2,881,717 for a paper board dome, U.S. Pat. No. 2,905,113 for a plydome, U.S. Pat. No. 2,914,074 for a catenary (geodesic tent), and other similar references such as U.S. Pat. No. 3,063,521, U.S. Pat. No. 3,139,957, U.S. Pat. No. 3,197,927, U.S. Pat. No. 3,203,144, and U.S. Pat. No. 3,810,336.

Another reference which pursues the notion of a building component/utilizing a panel is Zeihbrunner, U.S. Pat. No. 4,646,502 which teaches a panel construction element and building construction system employing such elements. That reference illustrates a profile frame and a filler material with cover panels that cover both the filler material and the profile frame. The frame includes a complex cross-section of a type fabricated using an extrusion, which, in turn, leads to a substantially more expensive structure than that provided by the present invention without the interlocking advantages of the framing with the filler or polymeric material of the present invention.

Similarly, efforts have been made to provide methods of construction using modular building components which produce building walls combining the coverage of area with insulation benefits. Several of these include two patents to Meyerson, U.S. Pat. Nos. 4,769,963 and 5,086,599, both of which involve utilizing an expanded polymeric material taken in combination with aluminum sheet to produce a building panel with excellent insulation properties in a light weight construction component. To the extent that an expanded polymeric material is utilized in these references, they bear some resemblance to the present invention. However, the resulting walls lack any significant structural strength because they are merely the combination of flat and folded aluminum or similar type material in combination with the expanded polymeric material.

Nemmer, et al., U.S. Pat. No. 4,633,634, issued on Jan. 6, 1987, discloses a building side wall construction panel and method. Nemmer includes foam cores connected edge to edge by connecting studs, the studs being two C-shaped channels welded back-to-back. To assemble Nemmer, the studs are secured upright and the foam cores are slid vertically downward into the open C-shaped sides of the studs. A problem with the Nemmer method is that a workman would have to carry tall and possibly unwieldy foam cores to roof level and try to jam their edges into and all the way downward along the stud C-channels to the level of the foundation. This precarious procedure is difficult and places the workman at risk. The double C-shape stud design makes it impossible for the workman to set the cores individually into place from ground level.

Switzerland Patent Number 396,368 teaches an interior wall panel assembly. The back-to-back C-shaped studs require either the procedure set forth in Nemmer where cores are forced downward from roof level, or pre-fabrication of the entire wall in a horizontal plane followed by tilting the wall upright. A complete wall would be heavy and dangerously cumbersome for one or even several workmen to lift upright and position properly. Such a complete wall, if assembled off site, would also be prohibitively bulky and unwieldy to transport.

A rough translation of Switzerland patent 396,368 indicates that it discloses an interior panel which is not load-bearing. "It is quite known to use (provide) gauge frame and panel elements to build interior walls." Switzerland '368 patent, line 1. There is apparently no teaching that the panels (11, 12, 13, 14) are "rigid", and indeed they would not need to be rigid to function as non-load-bearing interior dividers or wall panels. The panels are formed of rectangular foam cores having channel members secured along the core edges. The channel members have a cross-section like those of Nemmer, except that ledges are provided along the longitudinal edges of the C-shaped channels. The ledges are fit into grooves in core faces near core edges, but these ledges would not necessarily retain the insulation core against buckling under vertical compression loading. The Switzerland channel flanges are revealed to be very flexible and loose in the groove, and indeed too flexible and loose to be capable of retaining the core under vertical loading. Switzerland FIG. 2 shows a composite panel wall only partially assembled, which is described as a "dividing wall in building procedure". Two of the individual cores do not yet have channel members on their top edges. One can see the empty groove along the top edge of each. Yet to complete the wall, such a top channel member must be inserted on each of those top edges. A top channel member cannot be slid into the grooves from the side of the panel, because it is blocked by vertical members 30, 40 and 50. The only way to do so at this stage of the construction, without taking the wall apart again, would be to spread the channel flanges apart to fit over and around the top edge of the particular core. Then the flange walls would be released to resiliently snap into the core engaging grooves. Given that this approach is the only direct way to make progress on the completion of this wall, this must be the intended assembly procedure. The top channel flanges are, presumably, of the same material and strength as the side channels. If the channel flanges are so soft and flexible that they can be readily spread apart for installation, the channel flanges are clearly too soft and flexible to retain the core against buckling under the vertical compression loading typical of outer wall panels. If the core grooves are wide enough to let the channel ledges pivot down and around into them, they are too wide to securely retain the ledges under core loading. The flanges would simply spring apart and let the core buckle and fail. Of course, the Switzerland channel flanges do not have to carry a load, since they are apparently part of an interior wall structure.

The present invention relates to a method of building a unique composite assembly that may be utilized for the construction of walls, roofs, and flooring, for a variety of structures and buildings. The preferred materials are steel for structural strength in a very specific interlocking relationship with an expanded polymeric material such as medium density polystyrene or polyurethane. The steel provides strength in both tension and compression, while the expanded polymeric material provides thermal and sound insulation and substantial support in compression. The combination, therefore, provides a structural strength that is believed to be absent from the Meyerson references while at the same time providing the high insulation effects that these Meyerson references would be expected to provide, as well as having the advantage of low cost resulting in part from pre-fabrication and the ability to utilize the same in combination with external and internal facing materials that provide aesthetics, protection from the elements, functionality, some additional insulation, and minimal construction labor. Indeed, the present inventive method produces an excellent substitute for concrete block when the same is used with a prestressed concrete frame, and with the optional exterior and/or interior surfaces, can also replace the materials normally applied to the exterior and/or interior of concrete block.

The present invention also relates to a method of assembling a load-bearing, insulating building wall which permits a single workman to safely assemble an entire wall without the need for lifting equipment. Load-bearing, insulating panels of a size and weight which can be carried by a single workman are set upright and secured in place one at a time according to the method, to progressively form a wall.

SUMMARY OF THE INVENTION

Bearing in mind the foregoing, it is a principal object of the invention to provide a method of constructing a panel building component and wall that is light weight, low cost, has strong insulation properties, and excellent structural qualities.

Another object of the invention is to provide a method of constructing a panel building component that cooperates with a plurality of external and/or internal facing materials to produce an attractive, functional, and fire resistant structure.

A further object of the invention is to provide a method that is suitable for the replacement of concrete block construction.

A related object of the invention is to eliminate the waste as caused by the use of concrete blocks such as the additional ten percent builders normally order for breakage as well as the added waste when window and door openings are not eliminated from estimates.

Another object of the invention is to provide a method which eliminates the need for tie beams, columns, furring, and insulation.

A further object of the invention is to provide a method which allows the finished materials to be laminated directly to the wall surface in a pre-fabricated format.

One more object of the invention is to reduce construction site clean-up costs as is caused by block, stucco, furring, tie beam and column work.

Another object of the invention is to reduce time consuming and expensive inspections on columns and tie beams.

Yet another object is to provide a method which permits pre-fabrication using optimum materials assembled under plant controlled conditions because of its pre-fabrication characteristics.

An additional object of the invention is to provide a method which can be partly executed by mass producing in a high productivity and quality controlled environment at minimum cost.

A further object of the invention is to provide a method which can be partially completed in a manufacturing plant with pre-installation of doors and windows which can be pre-wired for electricity and other installations.

A further object of the invention is to provide a method for producing a panel building component which will not shrink, swell, or warp out of its designed shape, and will be unaffected by climatic changes, rot, or vermin.

One more object of the invention is to provide a method of load bearing wall assembly which can be safely executed by a single workman without need of heavy equipment.

Other objects and advantages of the present invention will become apparent to those skilled in the art upon examination of the following detailed descriptions and the drawings.

In accordance with the principal aspect of the present invention, there is provided a method of fabricating a load-bearing, insulating building wall and of forming a building wall on a foundation of a building, the foundation having a foundation edge and an elongate foundation recess parallel with and spaced apart from the edge of the foundation, and a panel fastener element protruding from the recess. The method includes the following steps: Forming a foam core having an interior face and an exterior face and opposing side edges each having a length, a top edge and a bottom edge; forming a groove in the interior face and a groove in the exterior face substantially parallel with and spaced apart from the first side edge; forming a vertical member having a web portion with web portion longitudinal edges, a flange portion at each the web portion longitudinal edge, the flange portions each having a flange portion longitudinal edge, and a ledges at each the flange portion longitudinal edge; cutting the vertical member to substantially the length of the first side edge; positioning the vertical member such that the ledges are aligned with one end of the grooves; sliding the vertical member into and along the grooves to substantially cover the first side edge; forming a foot member having a web portion with two longitudinal edges and a flange portion at each the web portion longitudinal edge, cutting the foot member to substantially the length of the bottom edge, fitting the foot member having a foot member opening over the bottom edge of the core; forming a cap member having a web portion with two longitudinal edges and a flange portion at each the web portion longitudinal edge; cutting the cap member to substantially the length of the top edge; fitting the cap member over the top edge of the core; joining the vertical member and the cap member, and the vertical member and the foot member, together with fasteners, lifting the panel and placing the foot member into the recess, such that the foot member opening fits around the concrete fastener element; orienting the panel in an upright position; opening a void in the core adjacent to the foot member corresponding in location to concrete fastener element; inserting a securing element into the void and joining the securing element to the concrete fastener element to secure the panel within the recess; securing a header member adjacent the top edge and to another part of the building to further secure the panel.

The method may include the additional steps of forming a second pair of grooves in the interior face and in the exterior face substantially parallel with and spaced apart from the second side edge; forming a second vertical member having a web portion with two web portion longitudinal edges, a flange portion at each the web portion longitudinal edge, the flange portions each having a flange portion longitudinal edge, and a ledge at each the flange portion longitudinal edge; cutting the second vertical member to substantially the length of the second side edge; positioning the second vertical member such that the ledges are aligned with one end of the grooves; sliding the second vertical member into and along the grooves to substantially cover the first side edge.

The method may further include the steps of fitting external and internal facings over the wall, securing the facings to at least one of the vertical member, the cap member and the foot member with fasteners.

Finally, the method may include the additional steps of forming a second the panel; placing the second panel into the recess adjacent to the first panel; placing a tie strap diagonally across the first and second panels; and, securing the strap to at least one of the vertical members to secure the first and second panels together.

BRIEF DESCRIPTION OF THE DRAWINGS

The invention will be better understood upon reference to the following detailed description and the drawings in which.

DETAILED DESCRIPTION

Materials and Structural Relationships for Method

Figure 1:
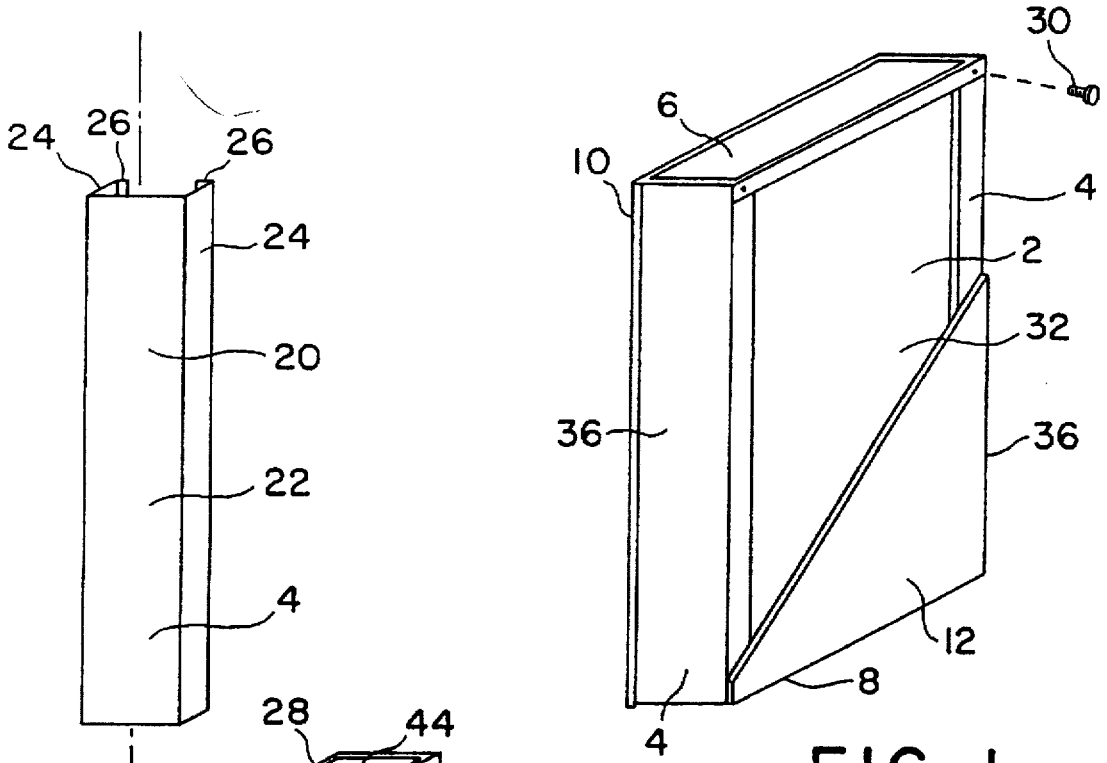
FIG. 1 is a perspective partially broken away view of the panel building component.

FIG. 1 illustrates in perspective view the inventive panel building component. A rigid insulation core 2 is preferably formed of an expanded polystyrene or similar expanded polymeric material, sometimes referred to as foam, having a high insulative characteristic and substantial strength in compression. The rigid insulation core 2 is surrounded about its periphery by a plurality of structural members including vertical members 4, a cap member 6, and a foot member 8. These structural members about the perimeter of rigid insulation core 2 may be attached at their intersections by conventional fastening means such as by welding or by at least one screw 30.

Optionally disposed in laminated association with the panel is an external facing 10 such as siding, reflective glass, a simulated stucco material, or the like. Such material can provide substantial aesthetics as well as add additional support and possible also insulative effects. Also shown is an optional internal facing material, such as a gypsum panel 12. Following installation of the panel in a construction site, wallpaper, paint, or other decorative materials may be readily applied to optional interior facing 12. Interior facing 12 is also preferably a fire resistant material, typically a five-eighths inch gypsum drywall having a finish rating of not less than sixty minutes. In fact, because of the importance of this feature for previously obtained approvals from code and other governmental agencies, the optional interior facing is shown disposed within the flanges of the cap and foot members, although the same may certainly be disposed in a laminated relationship exteriorly of these flanges.

Of greatest significance concerning this invention is the efficiency of materials in creating a building component of great strength and light weight. The interlocking aspects of the vertical members with lateral portions of rigid insulation produce integral composite columns having great strength.

Figure 2:
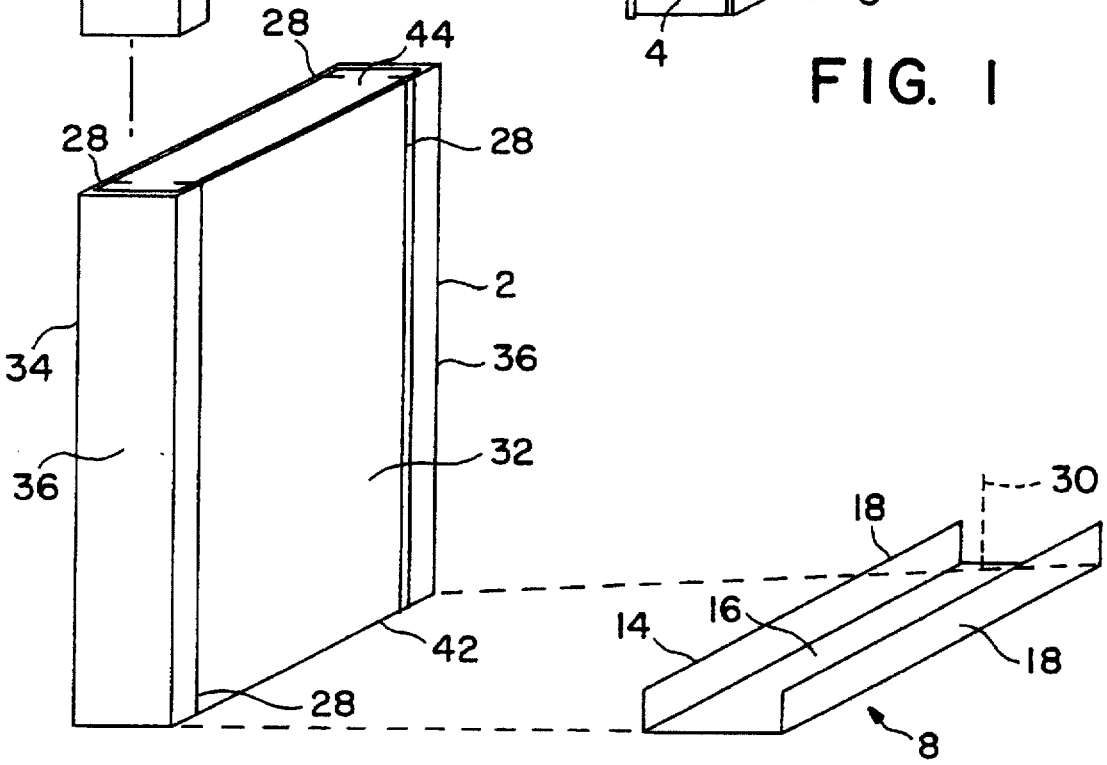
FIG. 2 is a perspective view of the rigid insulation core illustrating in exploded relationship one vertical member and one foot member from which the panel building component is constructed.

FIG. 2 shows the unadorned rigid insulation 2 after the same has been embossed with rigid insulation grooves 28 which are shown in four locations. These rigid insulation grooves are disposed to receive in engaging relationship portions of the vertical member 4 as hereinafter described.

Turning first to the foot member 8, it will be seen that in cross-section the foot member 8 has a standard channel 14 having a standard channel web 16 and standard channel flanges 18.

The vertical member 4 has a ledge channel cross-section 20 having a ledge channel web 22, ledge channel flanges 24 terminating in ledges 26. Ledges 26 are intended to be disposed in engaging relationship with rigid insulation grooves 28 when vertical member 4 is assembled with rigid insulation 2 to produce the integral composite columns having great strength. Grooves 28 preferably have a width relative to ledge 26 thickness to closely and snugly receive a ledge 26. This snug ledge 26 fit ensures a tight, high friction ledge 26 engagement in a groove 28 while panel 40 is under loading. The high friction engagement of ledge 26 helps retain the ledge 26 within groove 28. This great strength is achieved because the integral composite column thereby created utilizes the advantage of the compressive strength of the rigid insulation material to maintain the positional integrity of the steel of the vertical member 4, thereby avoiding lateral deflection thereof. In a complimentary manner, the steel prevents buckling of the lateral portions of the rigid insulation disposed within the ledge channel cross-section of the vertical members 4. Relatively light gauge steel has in some instances, for relatively light wall loading, been found satisfactory. Simultaneously, the lateral portions of the rigid insulation disposed within vertical members 4 remain integral with the remainder of the rigid insulation core that forms the central portion of the panel. Similar strength advantages are achieved with the cap member 6 and foot member 8, but the strength of the integral composite column is not ordinarily needed in the horizontal direction.

In special applications, the ledge channel configuration may be employed for the cap member 6 and/or foot member 8 as required. In such event, the rigid insulation 2 would be furnished with corresponding grooves to achieve an engaging relationship with the ledges to be added to the cap member 6 and/or foot member 8.

Figure 3:
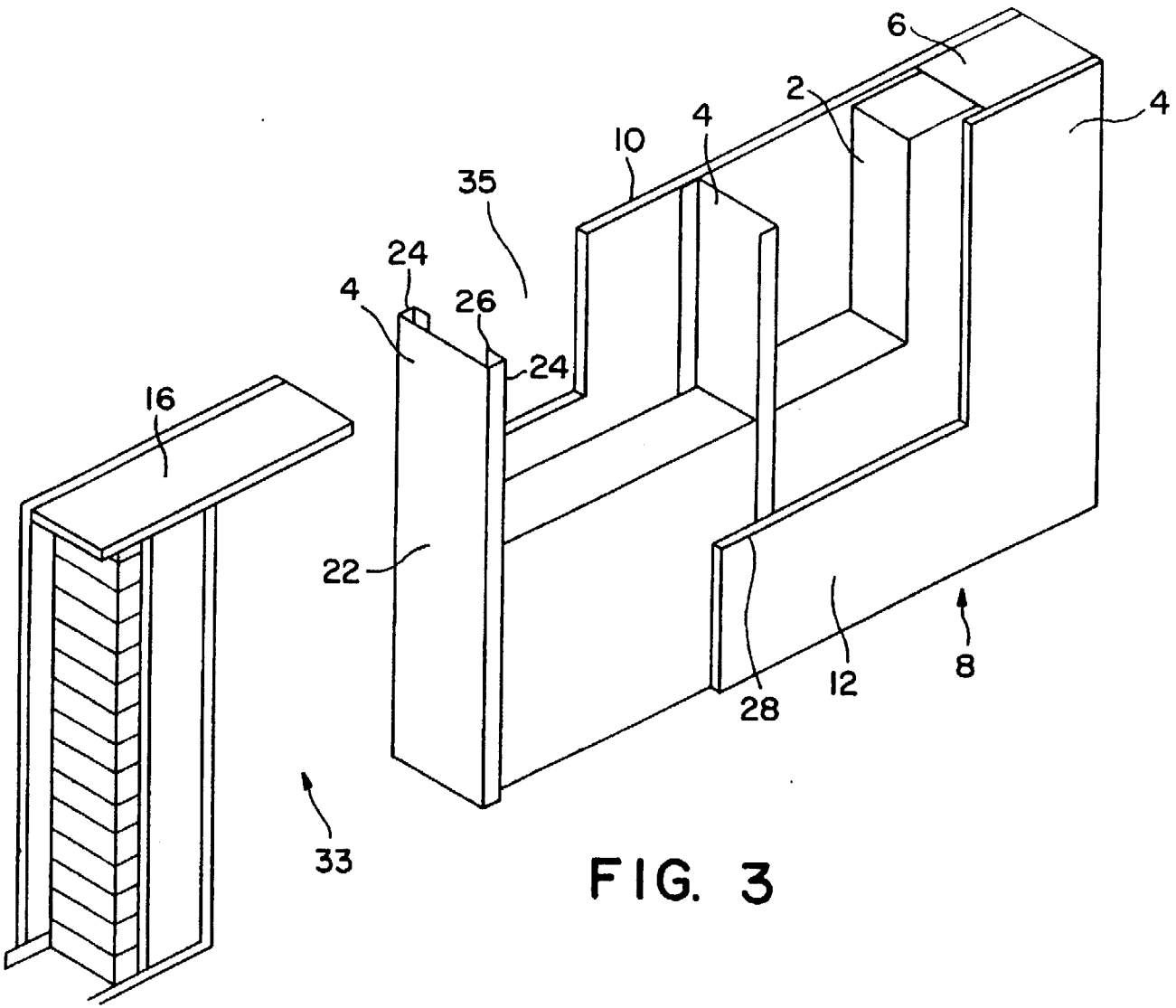
FIG. 3 show a partially broken away wall constructed of the panel building component and illustrating the disposition of window and door openings.

Turning to FIG. 3, there is shown in partially broken away view a wall constructed using the panel building component. Illustrated therein particularly is an door opening 33 and a window cut-out 35 which window cut-out is shown only in the external facing 10. The rigid insulation 2 is undercut to show the relationship thereof with vertical members 4. Also undercut is internal facing 12 and cap member 6. Also seen is the edge of foot member 8. Although the door and window are not illustrated, it will be readily appreciated that said items can be installed into the inventive panel building component at the factory manufacturing site.

Of particular interest in this figure is the utilization of three vertical members 4 in a single panel. Such panels are frequently four feet wide by eight feet high, although other dimensions are within the contemplation of the inventor. Depending upon the strength requirements for a particular edifice including those imposed by local building codes, it is appropriate to use more than two integral composite columns in a single panel. For example, in a location where a wall would ordinarily have studs on two foot centers, the same spacing can be achieved by using one additional integral composite column two feet from either lateral edge of a four foot wide panel. FIG. 3 illustrates how this is accomplished.

Careful examination of FIG. 3 also shows the interrelationship of the rigid insulation 2 with the channel ledges 26 which are disposed within rigid insulation grooves 28. The width of the ledge channel web 22 and the standard channel web 16 is seen to be substantially equivalent to the thickness of rigid insulation 2.

Method

Figure 4:
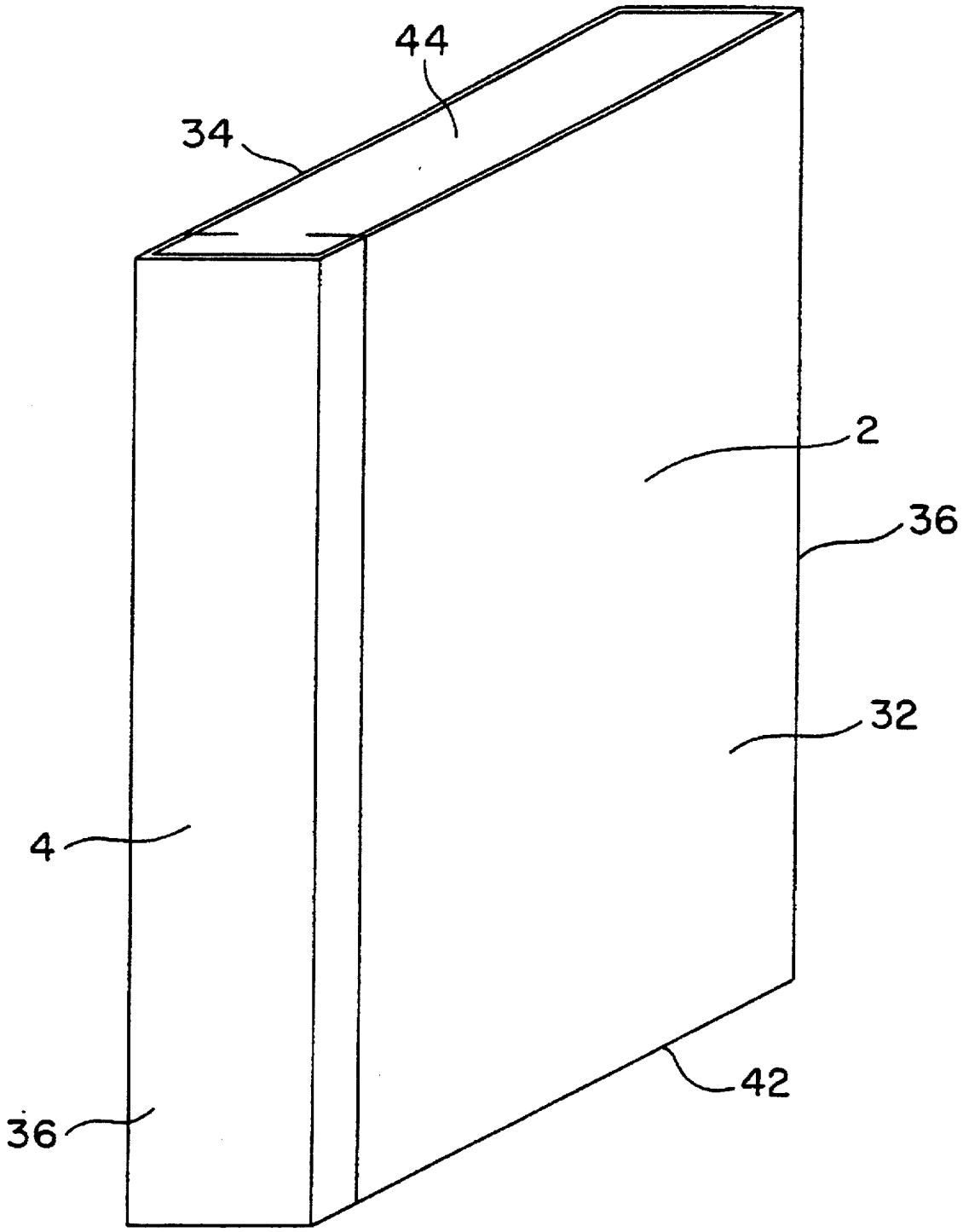
FIG. 4 is a view as in FIG. 2, except that the vertical member is fully inserted into the grooves.

A method of fabricating a load-bearing, insulating wall 31 is provided, which can be safely executed by a single workman without need of lifting equipment and which includes the following steps. A square or rectangular foam core 2 is formed having an interior face 32 and an exterior face 34 and two opposing side edges 36. A groove 28 is formed in interior face 32 and in exterior face 34 substantially parallel with and spaced apart from a first side edge 36. A vertical member 4 is cut to substantially the length of the first edge 36. Vertical member 4 is positioned such that ledges 26 are aligned with one end of grooves 28. Vertical member 4 is then slid along first edge 36 so that ledges 26 slide snugly into and along grooves 28 until the ends of vertical member 4 are adjacent the top and bottom of core 2. See FIGS. 2 and 4. A foot member 8 of substantially the same length as top edge 44 is fit over the bottom edge 42 of core 2. A cap member 6 of substantially the same length as bottom edge 42 is fit over the top edge 44 of core 2. Then vertical member 4 and cap and foot members 6 and 8 are joined together at their overlapping ends with fasteners 30, such as sheet metal screws. This combination constitutes a panel 40 in its simplest form.

Figure 5:
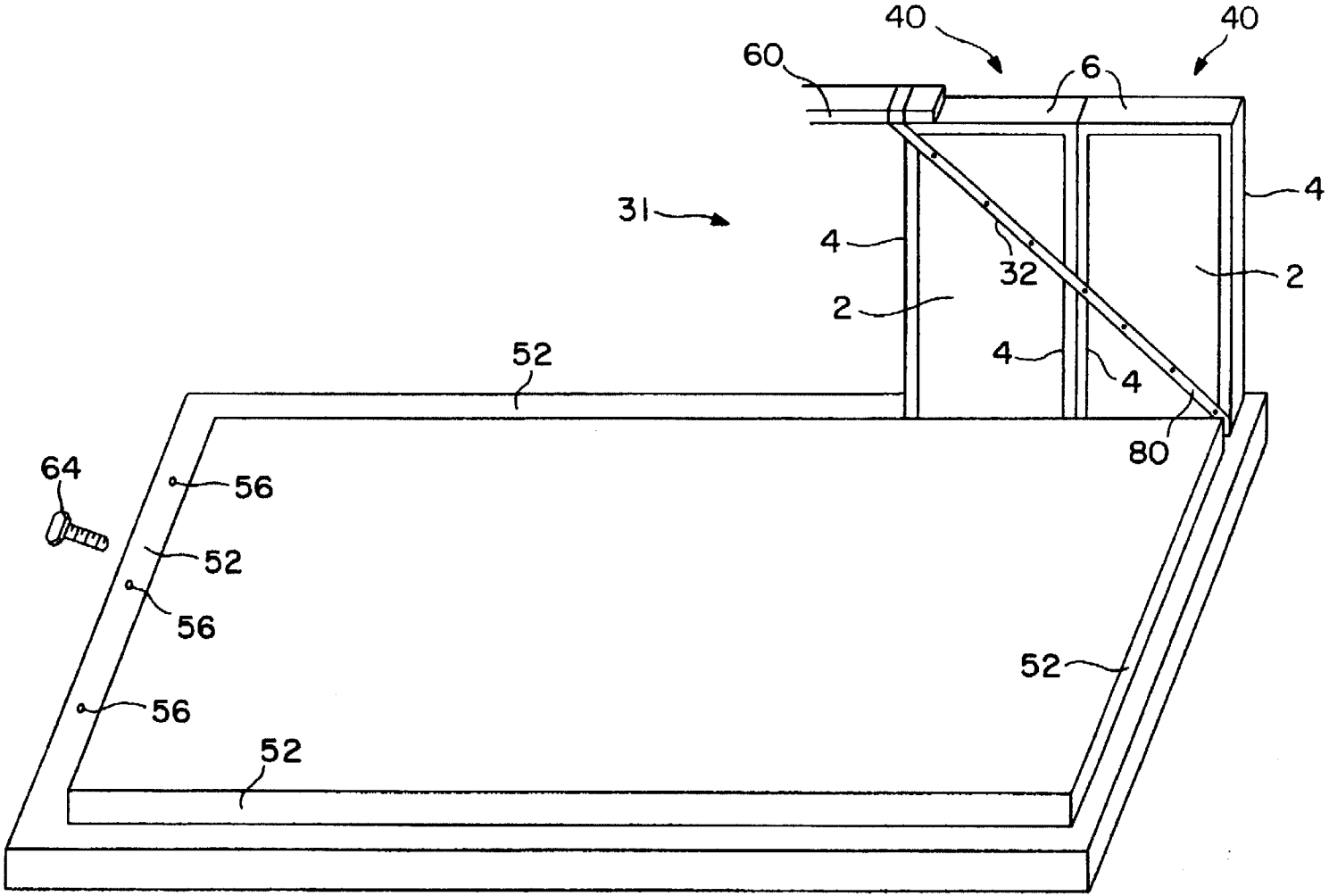
FIG. 5 is a perspective view of a building foundation with two panels secured into the elongate recess provided along the perimeter of the foundation.
Figure 6:
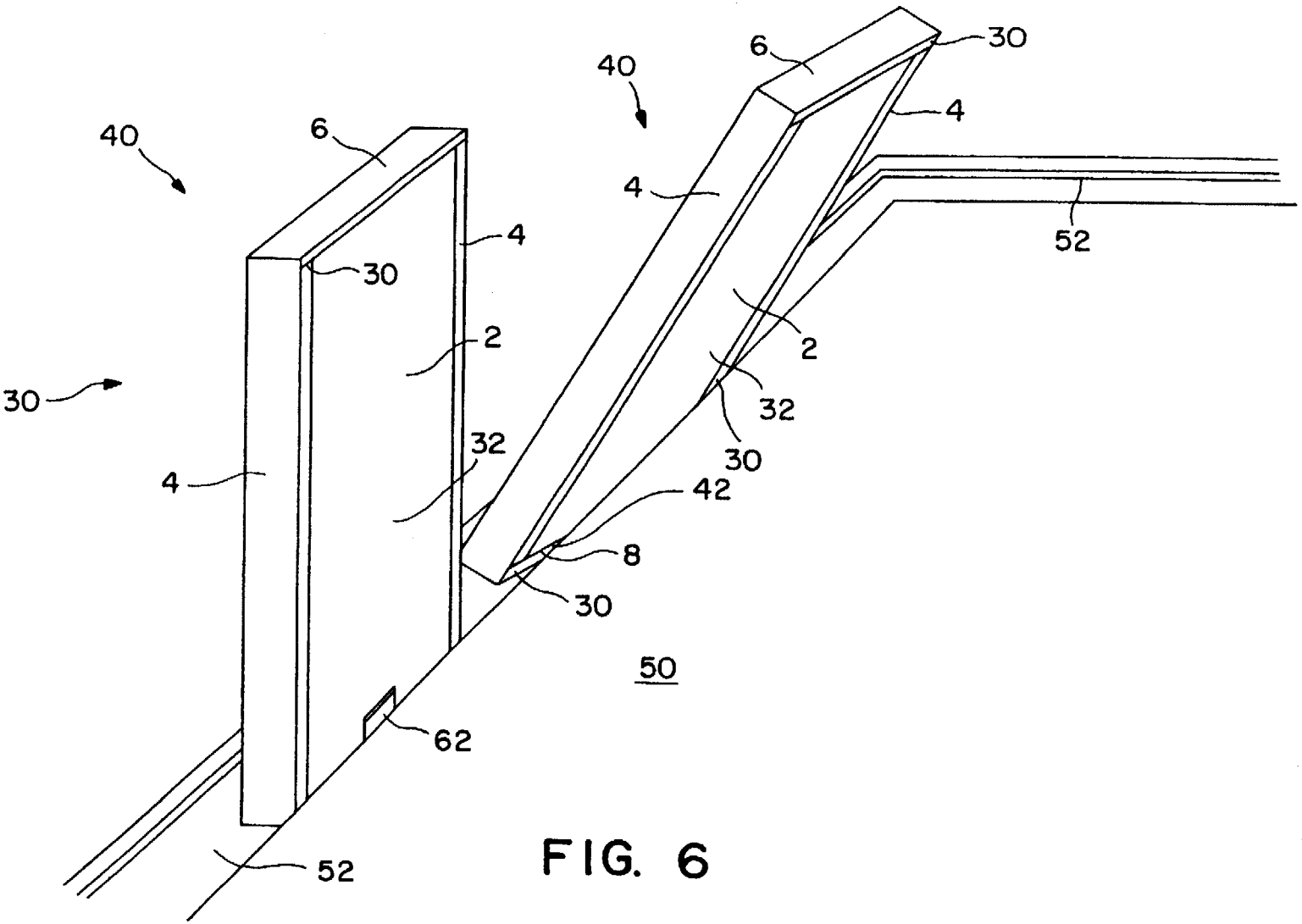
FIG. 6 is a perspective close-up view of a building foundation with one panel set upright in the recess and another being set into place next to it.
Figure 7:
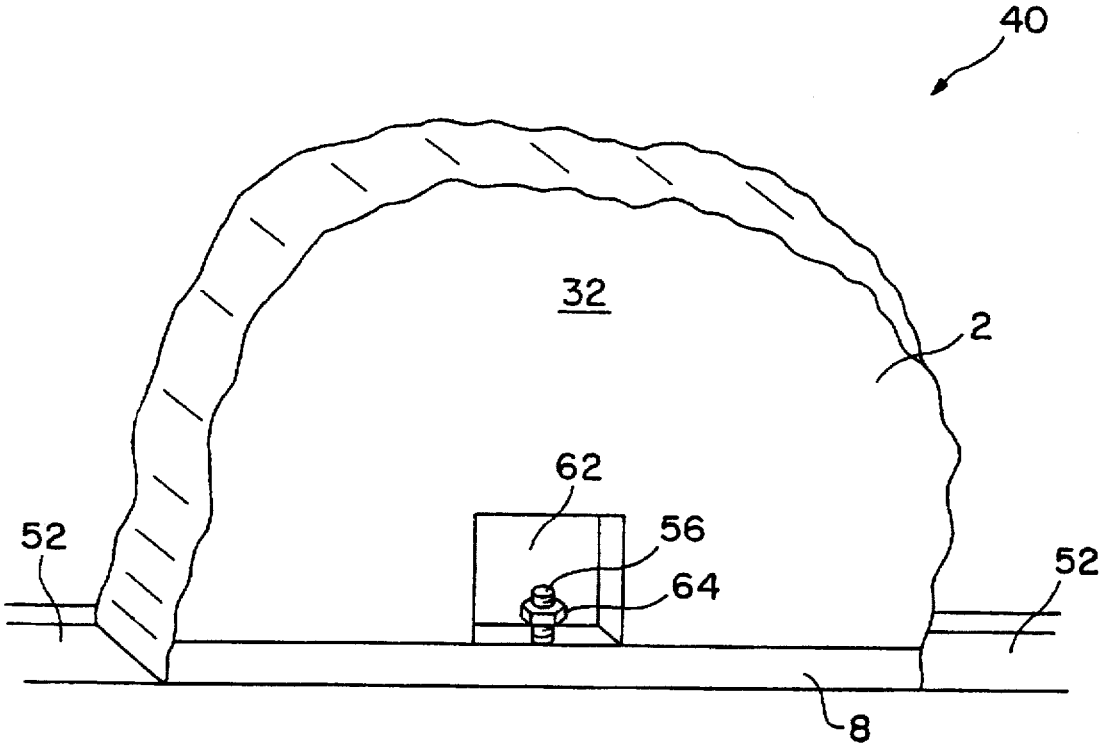
FIG. 7 is a close-up, broken away, front perspective view of the core portion containing the void, as shown in the nearest panel building component in FIG. 6, revealing the securing element, in this instance a nut, being screwed onto the concrete fastener element protruding upwardly from the foundation recess, to secure the panel building component within the recess.

A building foundation 50 is provided having foundation edges 54 and an elongate recess 52 parallel with and spaced apart from each edge 54. Recess 52 is slightly wider than foot member 8, and a panel fastener element 56 such as a bolt protrudes upward from recess 52. See FIG. 5. Panel 40 is lifted by a workman and foot member 8 of panel 40 is fitted into recess 52 with panel 40 in an upright position, or panel 40 is subsequently tilted into an upright position. See FIG. 6. A void 62 in core 2 adjacent to foot member 8 corresponding in location to fastener element 56 is opened either before or after panel 40 is placed in recess 52. A securing element 64 such as a nut is inserted into void 62 and joined to fastener element 56 to secure foot member 8 and thus panel 40 within recess 52. A header member 60 is fastened to cap member 6 and to another part of building 70 to further secure panel 40.

This method includes the optional additional steps of forming a second pair of grooves 28 in interior face 32 and in exterior face 34 substantially parallel with and spaced apart from the second side edge 36. See FIG. 2. A second vertical member 4 is cut to substantially the length of the second side edge 36. Second vertical member 4 is positioned such that edges 26 are aligned with one end of grooves 28, then second vertical member 4 is slid into and along grooves 28 until the ends of second vertical member 4 are adjacent the top and bottom edges 44 and 42 of core 2.

A second panel 40 may be formed according to the above-recited steps, and placed into recess 52, edge 36 to edge 36, and adjacent to first panel 40. A metal tie strap 80 is placed diagonally across first and second panels 40 and secured to vertical members 4 or cap and foot members 6 and 8 to secure first and second panels 40 together. See FIG. 5. Panels 40 are preferably sized to be of a breadth and weight which a single average workman can lift by himself. This is an important inventive feature of the present invention, because many prior panels have been designed so that they must be assembled into an entire wall 31 before they can be simultaneously uprighted. Such prior methods risk the health of the workman to complete, may require heavy equipment, and are needlessly awkward to perform.

External and internal facings 10 and 12 are then fitted over the entire broad surfaces of wall 31. Facings 10 and 12 are secured such as with fasteners 30 to vertical members 4 and cap and foot members 6 and 8.

Recess 52 helps seal the building 70 against the elements and also anchors bottom edges 42 of panels 40 against movement relative to foundation 50. The number of vertical members 4 selected for a given width of panel 40 and the gauge of vertical members 4 are determined according to the load each panel 40 must carry for a given application.

Having described the presently preferred embodiments of the invention, it should be understood that various changes in construction and arrangement will be apparent to those skilled in the art and fully contemplated herein without departing from the true spirit of invention. Accordingly, there is covered all alternatives, modifications and equivalents as may be included within the spirit and scope of the invention as defined in the appended claims.

What is claimed is:

1. A method of fabricating a load-bearing, insulating building wall on a foundation of a building, the foundation having a foundation edge and an elongate foundation recess parallel with and spaced apart from said edge of said foundation, and a panel fastener element protruding from said recess, comprising the steps of:

forming a foam core having an interior face and an exterior face and opposing first and second side edges each having a vertical length, a top edge and a bottom edge each having a width;

forming a groove in said interior face and a groove in said exterior face substantially parallel with and spaced apart from said first side edge, thereby forming a first pair of grooves;

forming a second pair of grooves in said interior face and in said exterior face substantially parallel with and spaced apart from said second side edge;

forming first and second vertical members each having a web portion with web portion longitudinal edges, a flange portion at each said web portion longitudinal edge, said flange portions each having a flange portion longitudinal edge, and a ledge at each said flange portion longitudinal edge;

cutting said first and second vertical members to substantially said vertical length of said first and second side edge;

positioning each said vertical member such that said ledges are aligned with one end of each pair of said grooves;

sliding said vertical members into and along said pairs of grooves in engaging relationship therewith to substantially cover said first and second side edges, thereby forming first and second integral composite columns of great strength;

forming a foot member having a web portion with two longitudinal edges and a flange portion at each said web portion longitudinal edge;

cutting said foot member to substantially the width of said bottom edge;

fitting said foot member having a foot member opening over said bottom edge of said core;

forming a cap member having a web portion with two longitudinal edges and a flange portion at each said web portion longitudinal edge;

cutting said cap member to substantially the width of said top edge;

fitting said cap member over said top edge of said core;

joining said integral composite columns and said cap member, and said integral composite columns and said foot member, together with fasteners, such that said foam core, said integral composite columns and said cap and foot members combine to form an individual weight-bearing and lightweight panel;

lifting said panel and placing said foot member into said recess, such that said foot member opening fits around said concrete fastener element;

orienting said panel in an upright position;

opening a void in said core adjacent to said foot member corresponding in location to concrete fastener element;

inserting a securing element into said void and joining said securing element to said concrete fastener element to secure said panel within said recess;

securing a header member adjacent said top edge and to another part of said building to further secure said panel.

2. The method of claim 1 comprising the additional steps of:

fitting external and internal facings over said panel, securing said facings to at least one of said vertical member, said cap member and said foot member with fasteners.

3. The method of claim 1, comprising the additional steps of:

forming a second said panel;

placing said second panel into said recess adjacent to said first panel;

placing a tie strap diagonally across said first and second panels;

and securing said strap to at least one of said vertical members to secure said first and second panels together.

4. The method of claim 1, in which the vertical member portion of said integral composite column is formed of metal.

5. The method of claim 4, in which the metal is steel.

* * * * *